United States Patent [19]

Gayton

[11] Patent Number: 5,060,687

[45] Date of Patent: Oct. 29, 1991

[54] BACKFLOW PREVENTER AND VACUUM BREAKER

[75] Inventor: David E. Gayton, Bay Village, Ohio

[73] Assignee: Moen Incorporates, Elyria, Ohio

[21] Appl. No.: 525,616

[22] Filed: May 21, 1990

[51] Int. Cl.[5] ..... F16K 24/00

[52] U.S. Cl. ..... 137/218; 137/512.4

[58] Field of Search ..... 137/218, 512.4

[56] References Cited

U.S. PATENT DOCUMENTS 2,322,631 6/1943 Groeniger ..... 137/218

3,122,156 2/1964 Kersh ..... 137/218

*Primary Examiner*—Gerald A. Michalsky

*Attorney, Agent, or Firm*—Kinzer,Plyer,Dorn,McEachran & Jambor

[57] ABSTRACT

An omnidirectional backflow preventer and vacuum breaker for use with a plumbing fixture in which the discharge may be moved to a position within a body of water includes a body having an inlet and an outlet, a chamber connecting the inlet and outlet and an air vent opening into the chamber. There is a diaphragm positioned within the chamber which normally closes communication between the inlet and outlet. The diaphram prevents water seepage from the outlet from reaching the air vent and has an integral one-way check valve positioned at the inlet which permits air from the vent to pass to the inlet to remove a vacuum condition therein.

8 Claims, 1 Drawing Sheet

BACKFLOW PREVENTER AND VACUUM BREAKER

SUMMARY OF THE INVENTION

The present invention relates to a backflow preventer and vacuum breaker for use with plumbing fixtures such as hand showers and kitchen pullout spouts.

A primary purpose of the invention is a device as described usable with a movable plumbing fixture which may have its discharge positioned within a body of water which device functions to prevent backflow and remove a vacuum condition in the inlet.

Another purpose is a backflow preventer and vacuum breaker as described which is omnidirectional in that it may be positioned in any orientation in its association with the plumbing fixture.

Another purpose of the invention is to provide a backflow preventer which will eliminate the characteristic dripping which comes from a hand shower if such is raised above the level of a tub deck or the like.

Another purpose is a simply constructed reliable backflow preventer and vacuum breaker using a single movable diaphragm to perform both functions.

Another purpose is a device as described which has a secondary check valve in the outlet to prevent water from the outlet from reaching the chamber connecting the inlet and outlet Another purpose is a backflow preventer as described which uses a diaphragm having an integral check valve which functions as a vacuum breaker, removing a vacuum condition at the inlet.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
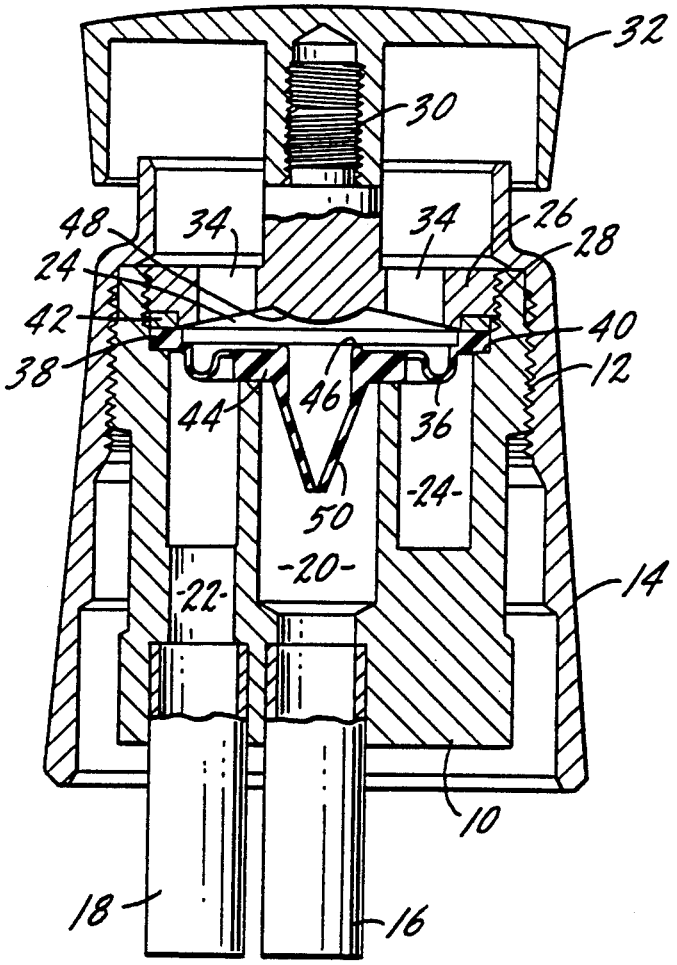
FIG. 1 is an axial section through a backflow preventer and vacuum breaker as described.

Present day plumbing fixtures for both the kitchen and bath include hand-held devices which can be moved about and may at times have the discharge positioned within a body of water such as a sink or bathtub. Specifically, in roman tubs it is common to provide a hand-held shower. In such an installation a diverter is required and plumbing codes now require a means for preventing back siphonage in connection with a diverter and a hand-held shower. Much the same is true in the kitchen in which pullout spouts have become common and there may be an auxiliary spray, again requiring a diverter and, by code, a device to prevent back siphonage. The present invention prevents backflow and removes a vacuum condition at the water supply, meeting code requirements for plumbing fixtures in which the discharge from the fixture, at times, may be positioned within a body of water. In addition, there is an auxiliary check valve positioned within the outlet which functions as a secondary means to prevent backflow from the outlet to the inlet.

In the drawings, the backflow preventer and vacuum breaker has a body 10 which has an exterior thread 12 used to mount an exterior decorative escutcheon 14. Body 10 mounts an inlet conduit 16 and an outlet conduit 18. Conduit 16 connects to an inlet passage 20 and conduit 18 connects to an outlet passage 22, with these two passages terminating in a chamber 24.

Figure 2:
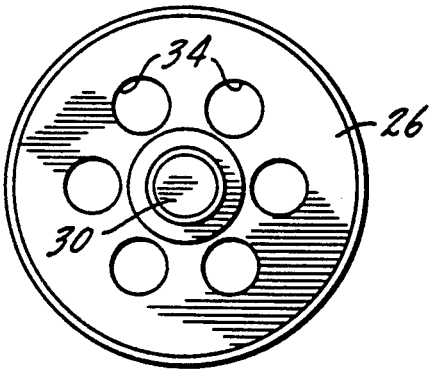
FIG. 2 is a top plan view of the cover.

The top side of chamber 24 is defined by a cover 26 which is threadedly engaged with the body, as at 28, and has an outwardly-extending stem 30 to which is mounted a cap 32. Cover 26, as particularly shown in FIG. 2, has a plurality of circumferentially arranged vent openings 34 which communicate with chamber 24.

Positioned within chamber 24 is an elastomeric flexible diaphragm 36 having an outward peripheral enlarged area 38 which is seated on a shoulder 40 of body 10. The diaphragm is held in position by a ring 42 with both the ring and the enlarged portion 38 of the diaphragm being secured by cover 26.

Diaphragm 36, in the normal at rest position, has a central portion 44 which rests upon the termination of inlet passage 20. Inside of central portion 44 the diaphragm has an upwardly-extending annular lip or raised area 46 which is positioned to close upon a seat 48 formed on the underside of cover 26. The diaphragm is completed by a pair of flexible normally closed lips 50, commonly referred to as a "duckbill," which lips extend into inlet conduit 20.

The at rest or normally closed position of the diaphragm is indicated in FIG. 1. When there is water flow in inlet passage 20, the diaphragm will be raised up and lip 46 will seal against seat 48. Such movement of the diaphragm within chamber 24 opens communication between inlet passage 20 and outlet passage 22 and water will flow through this connection to outlet conduit 18. In the event there is a vacuum condition in the water supply, creating a negative pressure in inlet passage 20, the diaphragm will be pulled down to the closed position of FIG. 1, preventing water from flowing from the outlet conduit 18 into inlet passage 20. At the same time atmospheric air will pass through the several vent passages 34, causing the duckbill 50 to open, relieving the vacuum condition at the inlet. Thus, back siphonage is prevented in that water cannot flow from outlet conduit 18 to inlet conduit 16. The diaphragm prevents such flow because it closes the outlet passage while at the same time the vacuum condition that creates the possibility of back siphonage is removed by vent passages 34 and the one-way check valve or duckbill 50.

It is common with hand-held showers that if the device is raised above the level of the support deck, water will drip back through the fixture supplying the shower. In the present construction, this is prevented by diaphragm 36 which seals the vent passages.

The device is particularly advantageous in that it is omnidirectional or it may be oriented in any disposition when mounted for its intended use. The diaphragm functions regardless of the manner in which it is positioned.

Figure 3:
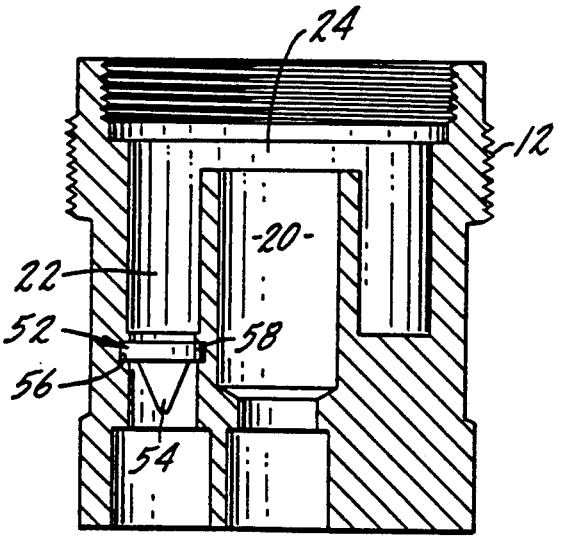
FIG. 3 is an axial section through the body showing a modified form of the invention.

FIG. 3 illustrates a modified form of the invention. A check valve 52 having a pair of flexible duckbill-type lips 54 is positioned within outlet passage 22. The passage may have an internal groove 56 which receives an extending rim 58 of the check valve to mount it in the passage. In the embodiment of FIG. 3, any water flow from the discharge device toward the outlet passage, and thus chamber 24, will be absolutely prevented by check valve 52. This valve, however, will not in any way inhibit free flow from the inlet to the outlet, as such flow will cause the flexible lips to open.

The present invention provides a simply constructed, reliable and compact backflow preventer and vacuum breaker. The single diaphragm in the FIG. 1 and 2 embodiment prevents both back siphonage and dripping. In the embodiment of FIG. 3 a second check valve is utilized to positively insure no backflow. The vent passages in the body construction are directly connected to the check valve on the diaphragm so as to quickly eliminate a vacuum condition at the inlet.

Whereas the preferred form of the invention has been shown and described herein, it should be realized that there may be many modifications, substitutions and alterations thereto.

The embodiments of the invention in which an exclusive property or privilege is claimed are defined as follows:

1. A backflow preventer and vacuum breaker for use with a plumbing fixture in which the discharge may be moved to a position within a body of water including a body having an inlet and an outlet, a chamber connecting said inlet and outlet, a vent in communication with said chamber, a seat in said chamber, and a diaphragm positioned within said chamber and normally closing communication between said chamber and said outlet, said diaphragm having an integral one-way check valve formed by a pair of normally closed flexible lips, said check valve being positioned at said inlet and permitting air from said vent to pass to said inlet to remove a vacuum condition therein, water flow from said inlet moving said diaphragm against said seat and opening communication between said inlet and outlet, said diaphragm further preventing water from said outlet in reaching said vent.

2. The backflow preventer of claim 1 further characterized in that said seat is positioned generally in axial alignment with said inlet, said diaphragm having an annular raised area in alignment with said seat.

3. The backflow preventer of claim 1 further characterized in that said body includes a cover, said vent being formed in said cover.

4. The backflow preventer of claim 3 further characterized in that said diaphragm is peripherally held between a shoulder on said body and said cover.

5. A backflow preventer and vacuum breaker for use with a plumbing fixture in which the discharge may be moved to a position within a body of water, including a body having an inlet and an outlet, a chamber connecting said inlet and outlet, a vent in communication with said chamber, and a diaphragm positioned within said chamber and normally closing communication between said chamber and said outlet, said diaphragm having an integral one-way check valve formed by a pair of normally closed flexible lips, said check valve being positioned at said inlet and permitting air from said vent to pass to said inlet to remove a vacuum condition therein, water flow from said inlet moving said diaphragm to open communication between said inlet and outlet, said diaphragm further preventing water from said outlet in reaching said vent.

6. The backflow preventer of claim 5 further characterized by and including a check valve in said outlet preventing water flow from said outlet to said chamber.

7. The backflow preventer of claim 6 further characterized in that said check valve includes a pair of normally closed flexible lips extending away from said chamber into said outlet.

8. The backflow preventer of claim 5 further characterized in that said diaphragm has a generally central portion thereof normally seated against said inlet, which portion prevents water from passing from said outlet to said inlet during a vacuum condition at said inlet.

* * * * *